US010288264B2

(12) United States Patent
Tang et al.

(10) Patent No.: US 10,288,264 B2
(45) Date of Patent: May 14, 2019

(54) LAMP

(71) Applicants: Zhisheng Tang, Zhongshan (CN); Guisheng Tang, Zhongshan (CN)

(72) Inventors: Zhisheng Tang, Zhongshan (CN); Guisheng Tang, Zhongshan (CN)

( * ) Notice: Subject to any disclaimer, the term of this patent is extended or adjusted under 35 U.S.C. 154(b) by 0 days.

(21) Appl. No.: 15/805,157

(22) Filed: Nov. 7, 2017

(65) Prior Publication Data

US 2018/0128455 A1 May 10, 2018

(30) Foreign Application Priority Data

Nov. 7, 2016 (CN) ..... 2016 1 0977291

(51) Int. Cl.

| | |
|---|---|
| ***F21V 21/26*** | (2006.01) |
| ***F21V 17/10*** | (2006.01) |
| ***F21V 19/00*** | (2006.01) |
| ***H01R 33/92*** | (2006.01) |
| *F21V 23/00* | (2015.01) |
| *F21V 23/06* | (2006.01) |
| *H01R 33/22* | (2006.01) |

(52) U.S. Cl.

CPC ..... *F21V 17/10* (2013.01); *F21V 19/006* (2013.01); *H01R 33/92* (2013.01); *F21V 23/002* (2013.01); *F21V 23/06* (2013.01); *H01R 33/22* (2013.01)

(58) Field of Classification Search

CPC ..... F21V 17/10; F21V 19/006; F21V 23/002; F21V 23/06

USPC ..... 362/414

See application file for complete search history.

(56) References Cited

U.S. PATENT DOCUMENTS

2006/0256561 A1* 11/2006 Smith ..... F21V 17/007 362/287
2007/0115654 A1* 5/2007 Ruben ..... F21S 8/06 362/221
2011/0182062 A1* 7/2011 Wilson ..... F21L 4/027 362/197
2012/0257395 A1* 10/2012 Cotzias ..... F21V 1/00 362/351
2015/0377457 A1* 12/2015 Barry ..... F21V 19/02 362/426

* cited by examiner

*Primary Examiner* — Karl D Frech
(74) *Attorney, Agent, or Firm* — Matthias Scholl P.C.; Matthias Scholl

(57) ABSTRACT

A lamp unit, including: a main stem including a first end and a second end, and at least two branches. The at least two branches extend outwards from the first end of the main stem. The second end of the main stem includes a connection part. One end of each branch includes a mounting part which is adapted to accommodate a light source or corresponds to a connection part of another lamp unit. In use, the connection part is electrically connected to the power supply, and each mounting part is provided with a light source or is connected to the connection part of another lamp unit. The invention also provides a lamp including a plurality of the lamp units.

19 Claims, 13 Drawing Sheets

LAMP

CROSS-REFERENCE TO RELATED APPLICATIONS

Pursuant to 35 U.S.C. § 119 and the Paris Convention Treaty, this application claims foreign priority to Chinese Patent Application No. 201610977291.9 filed Nov. 7, 2016, the contents of which and any intervening amendments thereto are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, and Cambridge, Mass. 02142.

BACKGROUND OF THE INVENTION

Field of the Invention

The present disclosure relates to a lamp unit, a lamp body comprising the same, and a lamp comprising the lamp body.

Description of the Related Art

The shape of conventional lamps is fixed, and this limits user experience.

SUMMARY OF THE INVENTION

It is one objective of the present disclosure to provide a lamp unit which has simple structure, a plurality of lamp units can be combined to form different lamps exhibiting a variety of individual shapes.

To achieve the above objective, in accordance with one embodiment of the present disclosure, there is provided a lamp unit, comprising: a main stem comprising a first end and a second end, and at least two branches. The at least two branches extend outwards from the first end of the main stem. The second end of the main stem comprises a connection part, which, when in use, is connected to a power supply. One end of each branch comprises a mounting part which is adapted to accommodate a light source or corresponds to a connection part of another lamp unit. In use, the connection part is electrically connected to the power supply, and each mounting part is provided with a light source or is connected to the connection part of another lamp unit.

In a class of this embodiment, the one end of each branch comprises a fixing part, and the mounting part is a lamp base fixedly disposed on the fixing part.

In a class of this embodiment, the lamp unit is a hollow structure and comprises two subunits, each subunit comprising one fixing part for fixing the lamp base.

In a class of this embodiment, the lamp unit is a hollow structure and comprises three subunits, each subunit comprising one fixing part for fixing the lamp base.

In a class of this embodiment, the subunits are assembled through a buckle structure, contact surfaces of the subunits comprise flanges and grooves which are corresponding to one another; when the subunits are assembled, the flanges are clamped in the grooves.

In a class of this embodiment, the second end of the main stem protrudes outwards to form an installation part, the installation part is sleeved with a lamp holder which corresponds to and is electrically connected to the lamp base, to form the connection part of the power supply.

In a class of this embodiment, the connection part is electrically connected to lamp bases in parallel, a side wall of each installation part for fixing the lamp base comprises an opening allowing power lines to pass through, one of the power lines extends out of a chamber of the lamp unit via the opening, winds on an outer side wall of the installation part, and is electrically connected to the lamp holder fixed on the installation part.

In a class of this embodiment, the main stem and the branches are formed by injection molding, the lamp base is fixedly clamped on the fixing part; one end of the lamp base for receiving a light source or a connection part of another lamp unit is provided with a convex tooth extending outwards to prevent the lamp base from detaching from the fixing part.

Advantages of the lamp unit of the present disclosure are summarized as follows: the lamp unit has a simple shape, and a plurality of lamp units can be combined to form different lamps exhibiting a variety of individual shapes.

It is another objective of the present disclosure to provide a lamp body comprising a plurality of lamp units that can exhibit different shapes.

The present disclosure provides a lamp body comprising a plurality of lamp units, when in use, the connection part of one of the plurality of lamp units is electrically connected to a power supply, and each mounting part receives a light source or is electrically connected to a connection part of another lamp unit.

Advantages of the lamp body of the present disclosure are summarized as follows: a plurality of lamp units can be combined to form different lamp bodies exhibiting a variety of individual shapes.

It is still another objective of the present disclosure to provide a lamp comprising a plurality of lamp units that can exhibit different shapes.

A lamp comprises a base and a lamp body disposed on the base, the base comprising a power socket, the lamp body comprising a plurality of lamp units, and when in use, the connection part of one lamp unit is electrically connected to the power socket.

Advantages of the lamp of the present disclosure are summarized as follows: a plurality of lamp units can be combined to form different lamps exhibiting a variety of individual shapes.

DETAILED DESCRIPTION OF THE EMBODIMENTS

For further illustrating the invention, experiments detailing a lamp unit, a lamp body comprising the same, and a lamp comprising the lamp body are described below. It should be noted that the following examples are intended to describe and not to limit the invention.

Figure 1:
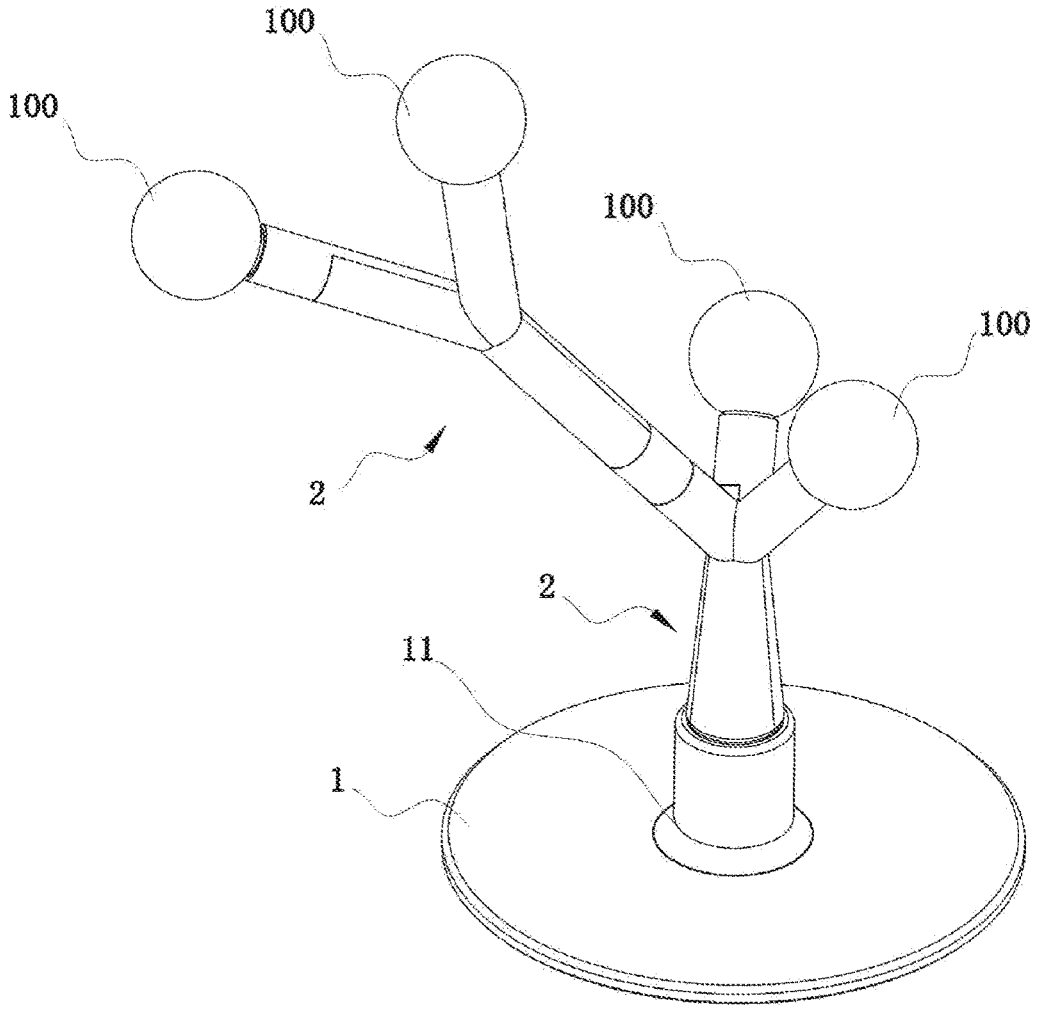
FIG. 1 is a schematic diagram of a lamp in accordance with one embodiment of the present disclosure.
Figure 2:
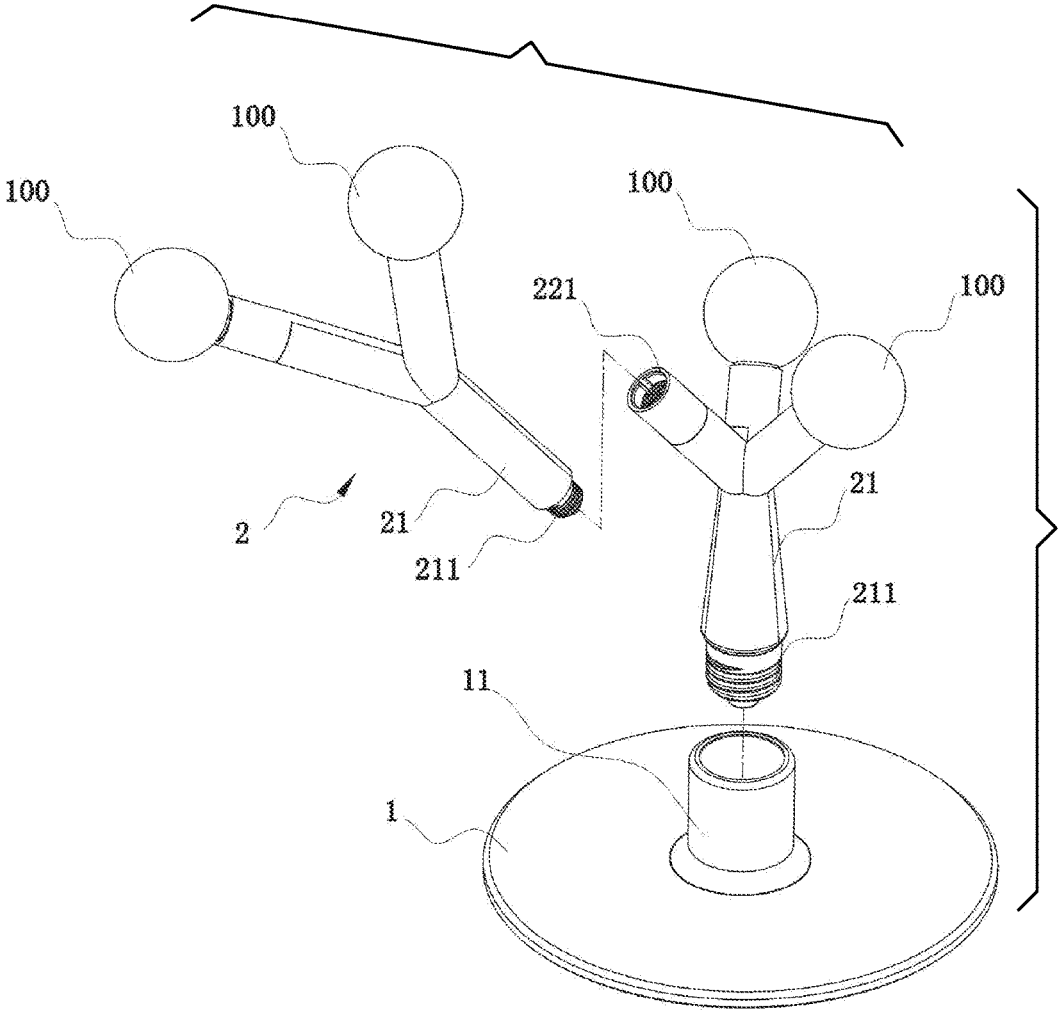
FIG. 2 is an exploded view of a lamp in FIG. 1.

As shown in FIGS. 1 and 2, a lamp comprises a lamp base 1 and a lamp body disposed on the lamp base 1. The lamp base 1 comprises a power socket 11. The lamp body comprises a plurality of lamp units 2, and one of the lamp units 2 can be used as a bottom component of the lamp. The lamp unit at the bottom of the lamp comprises a connection part 211. When in use, the connection part 211 is electrically connected to the power supply in the power socket 11 of the lamp base 1.

Figure 3:
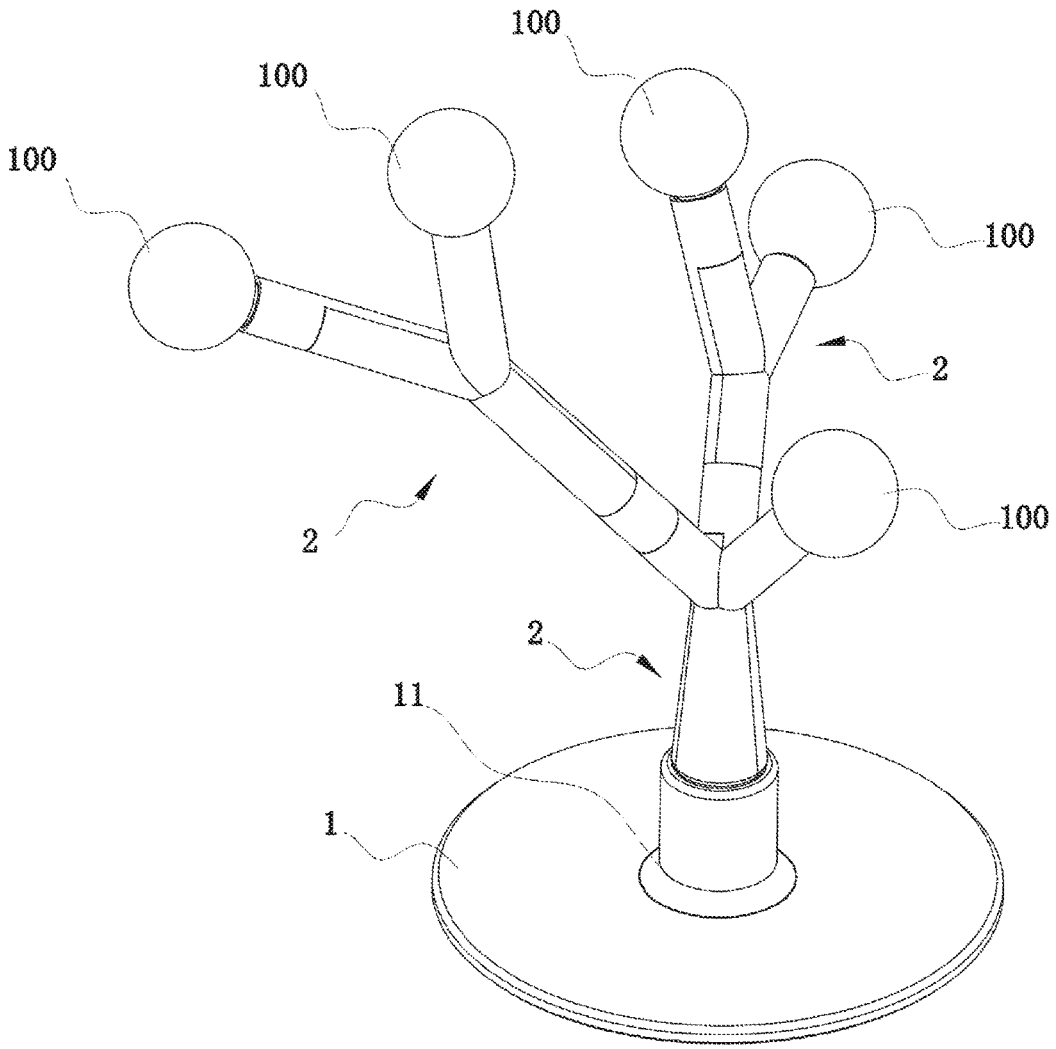
FIG. 3 is a schematic diagram of a lamp in accordance with another embodiment of the present disclosure.
Figure 4:
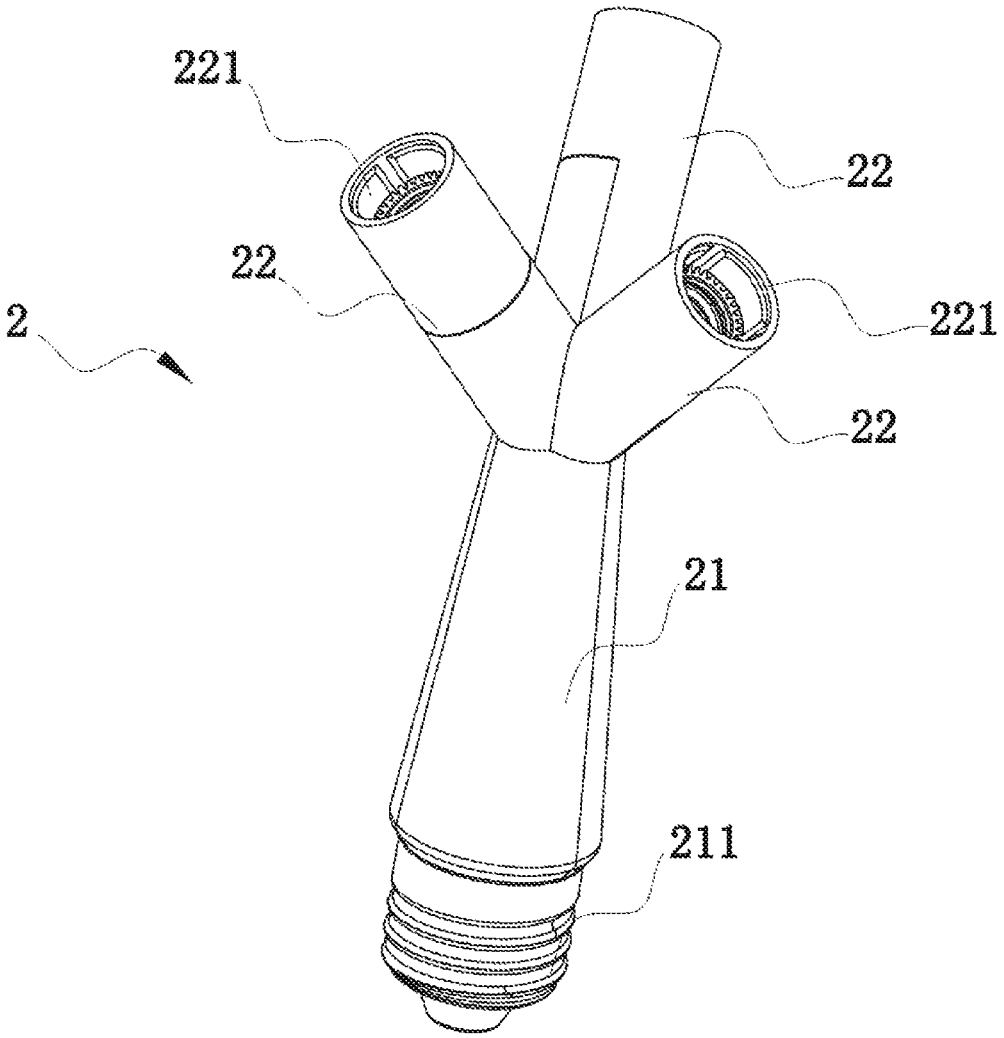
FIG. 4 is a schematic diagram of a lamp unit comprising one main stem and three branches in accordance with one embodiment of the present disclosure.
Figure 5:
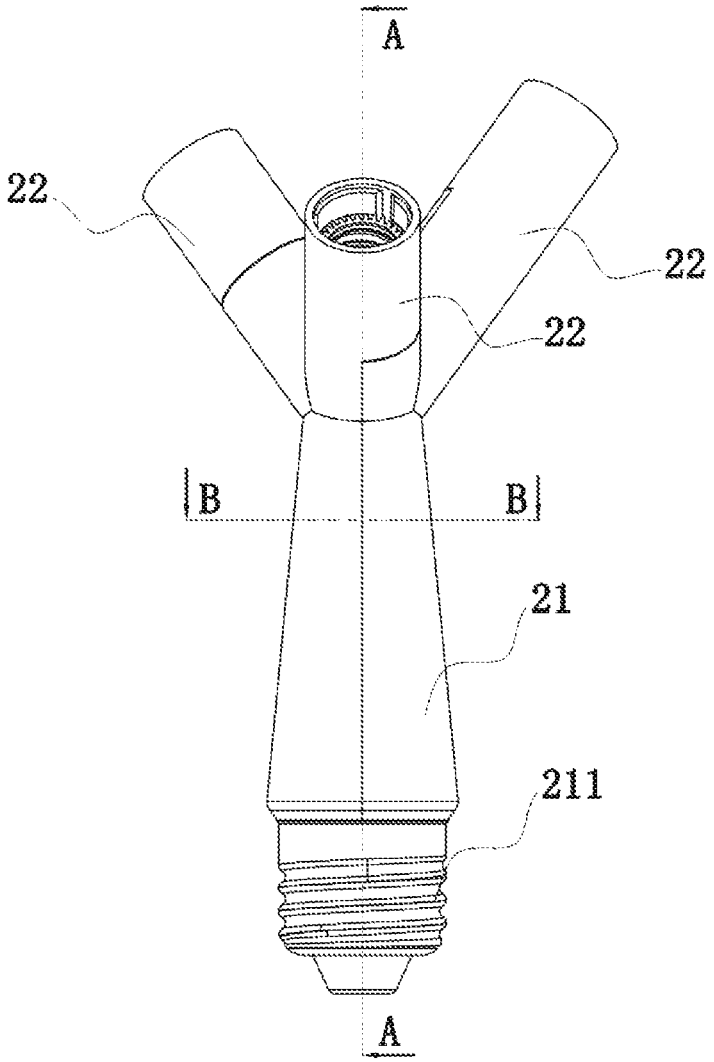
FIG. 5 is a front view of a lamp unit in FIG. 4.
Figure 6:
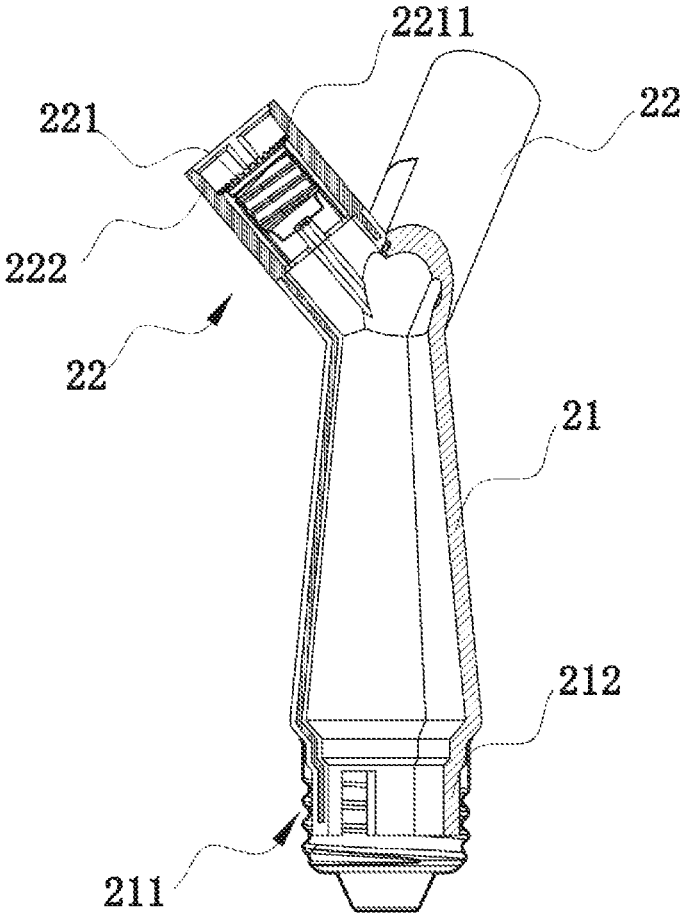
FIG. 6 is a sectional view of a lamp unit taken from line A-A in FIG. 5.
Figure 7:
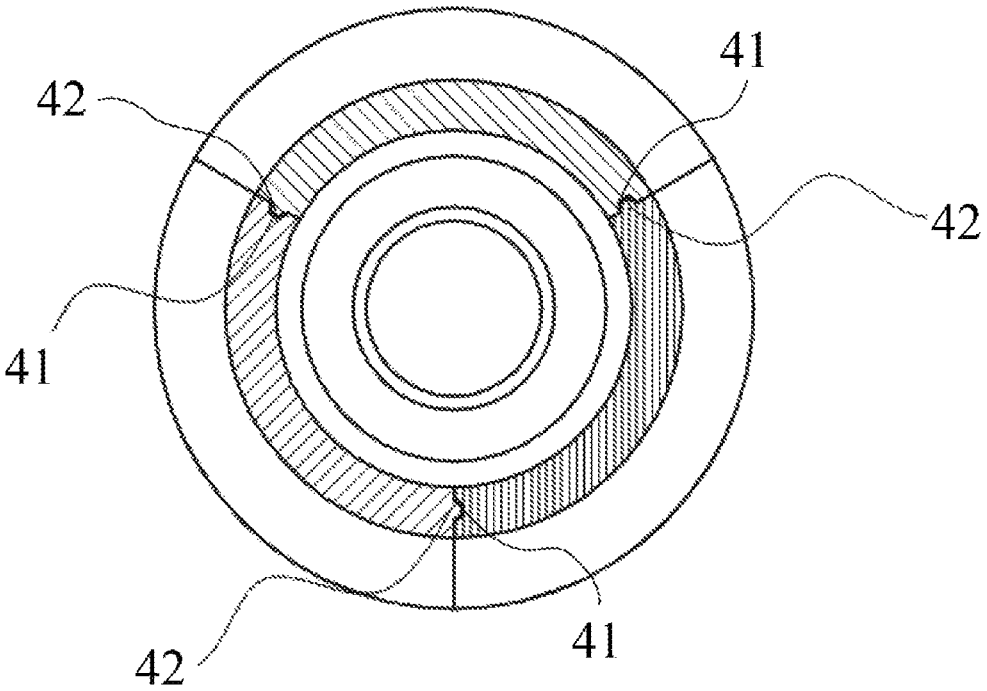
FIG. 7 is a sectional view of a lamp unit taken from line B-B in FIG. 5.
Figure 8:
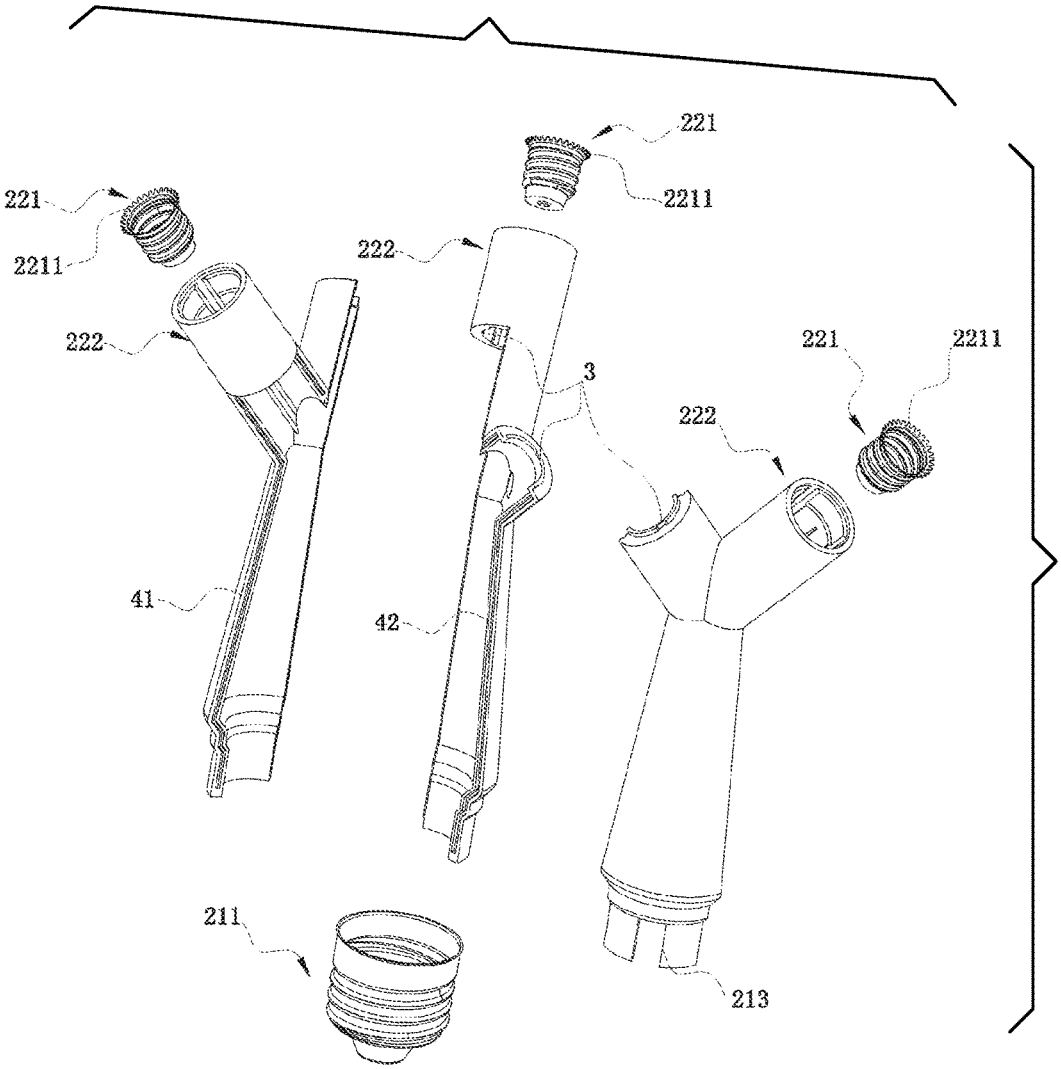
FIG. 8 is an exploded view of a lamp unit in FIG. 5.
Figure 9:
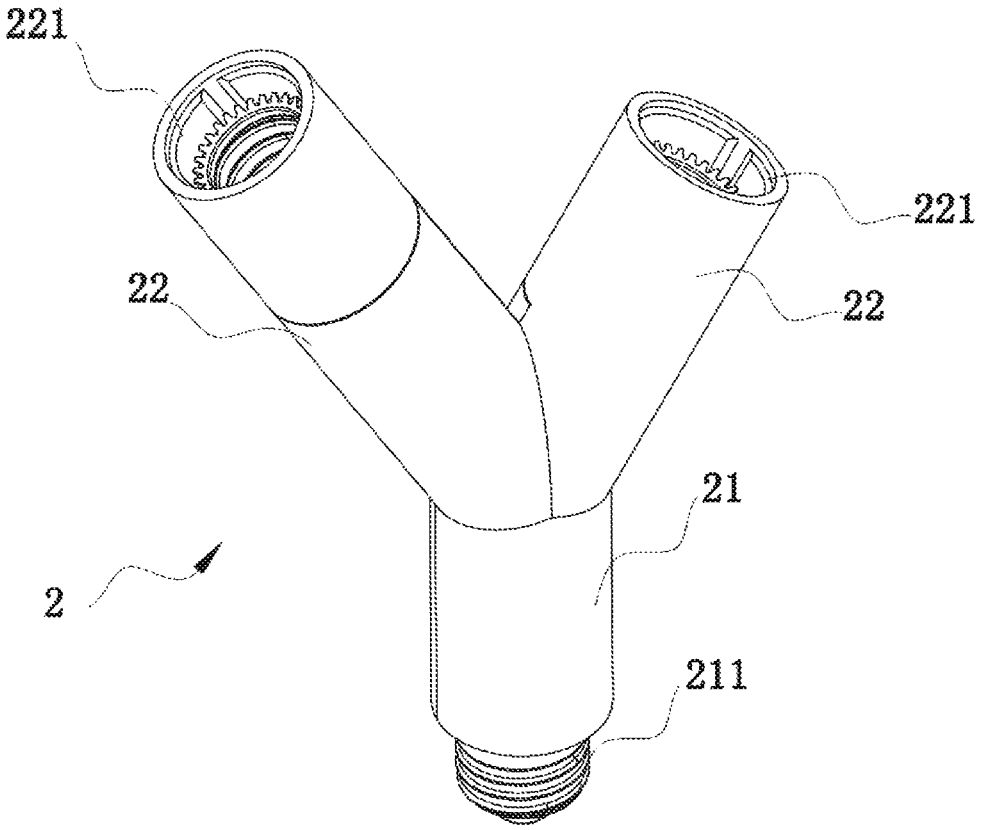
FIG. 9 is a schematic diagram of another lamp unit comprising one main stem and two branches in accordance with one embodiment of the present disclosure.
Figure 10:
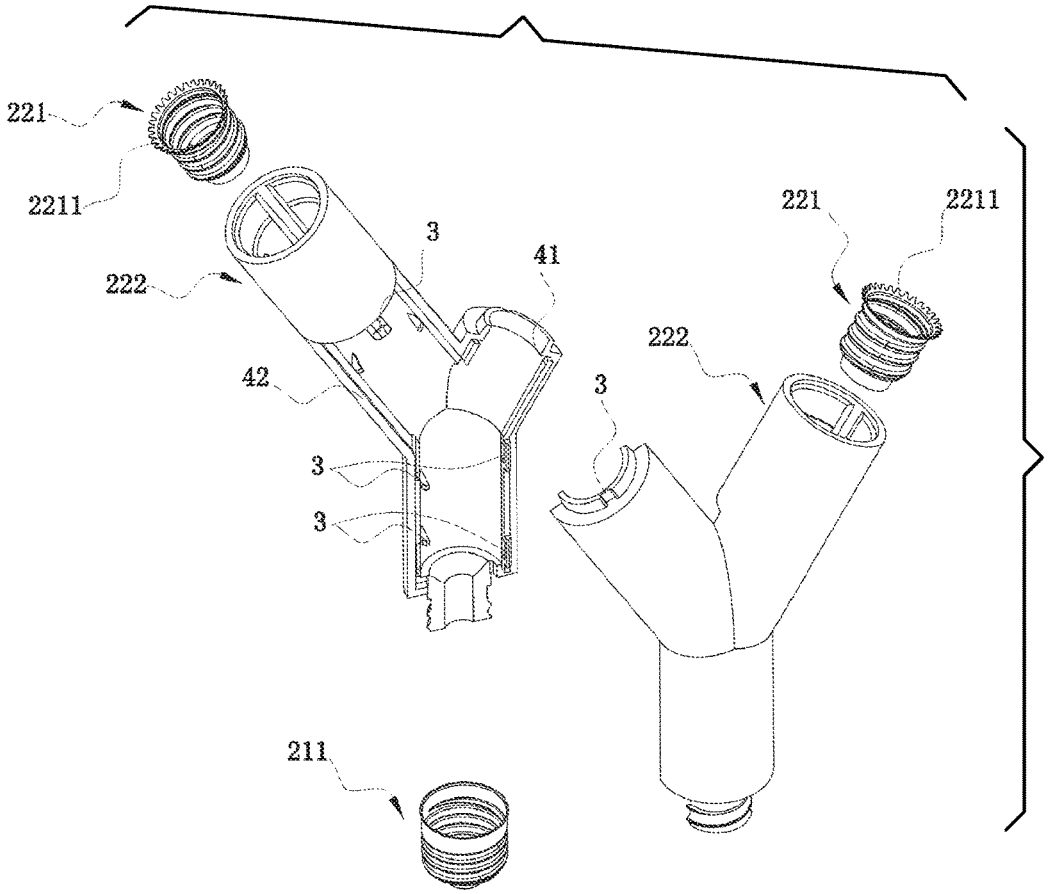
FIG. 10 is an exploded view of a lamp unit in FIG. 9.
Figure 11:
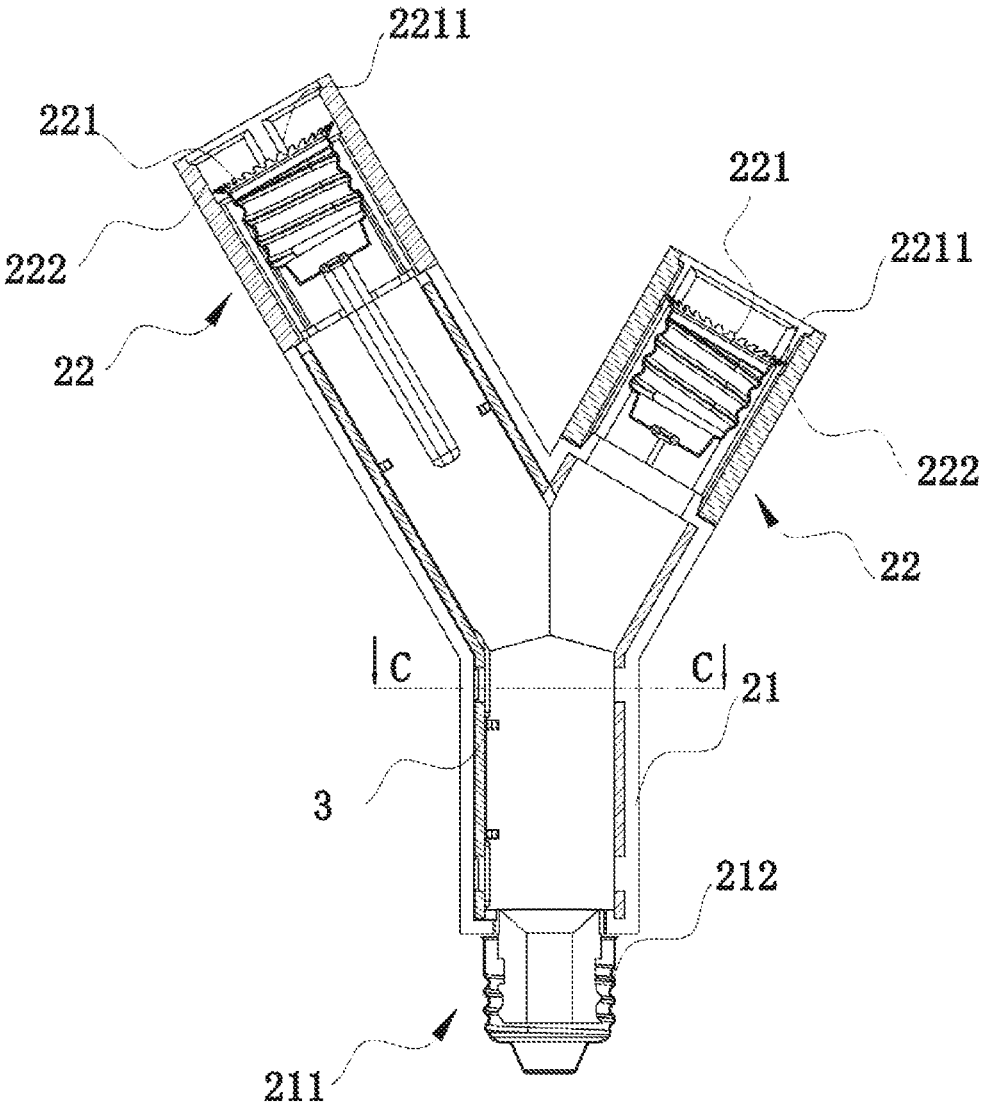
FIG. 11 is a longitudinal sectional view of a lamp unit in FIG. 9.
Figure 12:
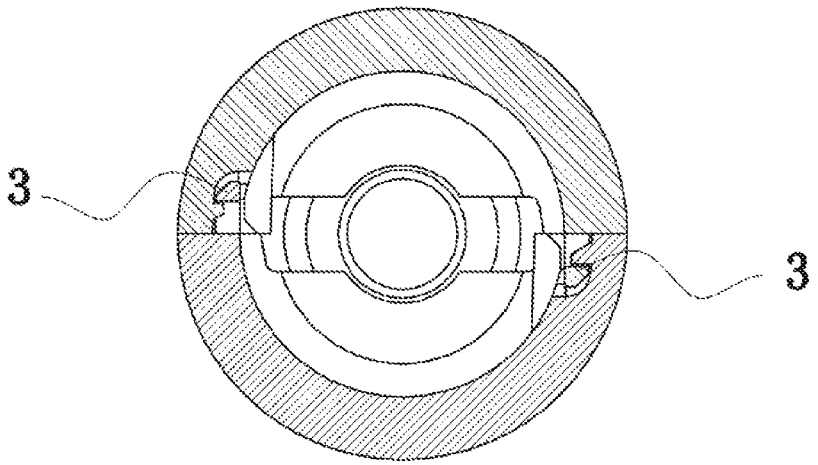
FIG. 12 is a sectional view of a lamp unit taken from line C-C in FIG. 11.

According to personal preference, the lamp body can present the shape as shown in FIG. 3. Theoretically, the assembled lamp body can present a variety of shapes.

The lamp units 2 can also present a variety of shapes, as shown in FIGS. 4-8, a lamp unit 2 comprises one main stem 21 comprising a first end and a second end, and three branches 22 extend outwards from the first end of the main stem 21, while the lamp unit 2 as shown in FIGS. 9-12 comprises one main stem 21 and two branches 22. Optionally, the lamp unit 2 can comprise one main stem 21 and more than three branches 22, just the lamp unit 2 comprising one main stem 21 and two branches 22 or one main stem 21 and three branches 22 is the most usual.

The second end of the main stem 21 comprises a connection part 211, which, when in use, is connected to a power supply. One end of each branch 22 comprises a mounting part 221 which is adapted to accommodate a light source 100 or correspond to a connection part 211 of another lamp unit. In use, the connection part 211 is electrically connected to the power supply, and each mounting part 221 is provided with a light source 100 or is connected to the connection part 211 of another lamp unit 2.

One end of each branch 22 comprises a fixing part 222, and the mounting part 221 is a lamp base fixedly disposed on the fixing part 222. The main stem 21 and the branches 22 are formed by injection molding, the lamp base is fixedly clamped on the fixing part 222; one end of the lamp base for receiving a light source or a connection part 211 of a power supply of another lamp unit 2 is provided with a convex tooth 2211 extending outwards to prevent the lamp base from detaching from the fixing part 222.

The lamp unit 2 is a hollow structure and comprises two or three subunits, each subunit comprising one fixing part 222 for fixing the lamp base. When the lamp unit 2 comprises one main stem 21 and two branches 22, it comprises two subunits; when the lamp unit 2 comprises one main stem 21 and three branches 22, it comprises three subunits.

It should be noted that, theoretically, the lamp unit 2 can comprises a different number of subunits, but considering the mold and manufacturing costs, it is reasonable that a lamp unit 2 comprises two or three subunits, and a lamp comprising the lamp unit 2 comprising two or three subunits is the most unique.

The subunits are assembled through a buckle structure 3, contact surfaces of the subunits comprise flanges 41 and grooves 42 which are corresponding to one another; when the subunits are assembled, the flanges 41 are clamped in the grooves 42. The second end of the main stem 21 protrudes outwards to form an installation part 212, the installation part 212 is sleeved with a lamp holder which corresponds to and is electrically connected to the lamp base, to form the connection part 211 of the power supply.

Figure 13:
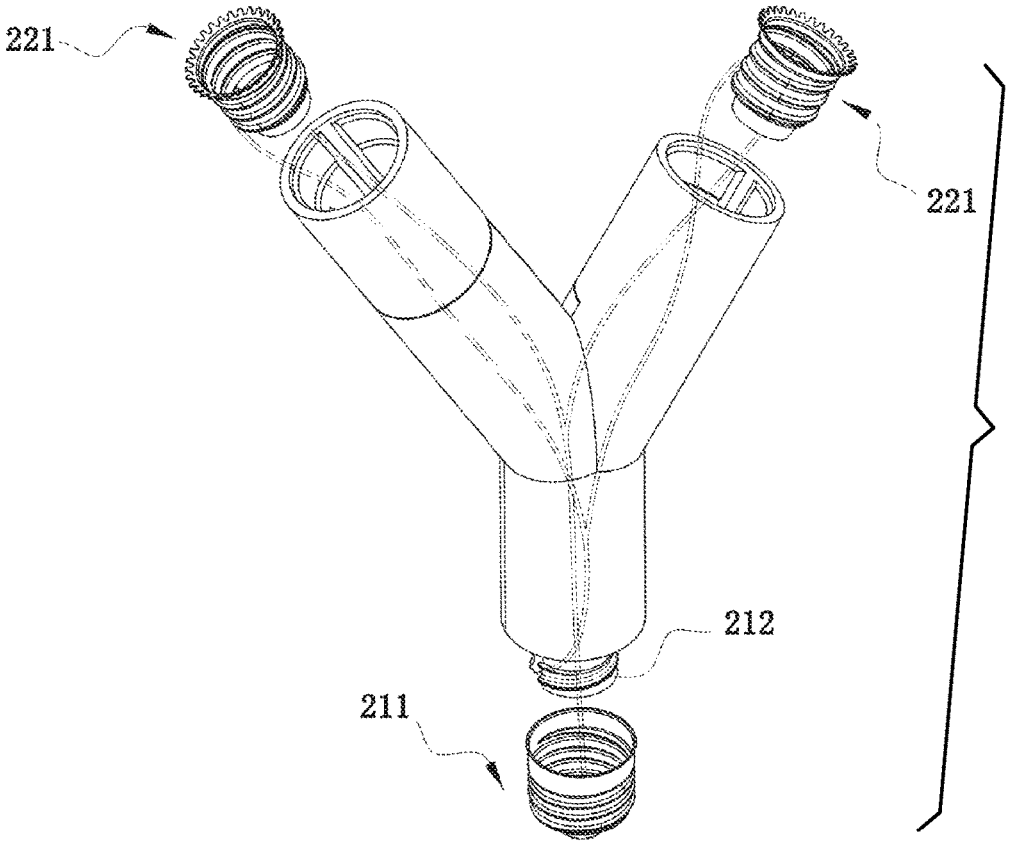
FIG. 13 illustrates an electric connection of a connection part and a lamp holder of a lamp unit comprising one main stem and two branches in accordance with one embodiment of the present disclosure.

The connection part 211 of the power supply is electrically connected to the lamp bases in parallel, a side wall of each installation part 212 for fixing the lamp base comprises an opening 213 allowing power lines to pass through; one of the power lines extends out of a chamber of the lamp unit 2 via the opening 213, winds on the outer side wall of the installation part 212, and is electrically connected to a lamp holder fixed on the installation part 212. FIG. 13 shows an electric connection of a connection part 211 and a lamp holder of a lamp unit 2 comprising one main stem 21 and two branches 22. To distinguish the power lines and the outlines of the lamp, the power lines are represented by dotted lines and run through in the chamber of the lamp unit 2. When the lamp unit 2 comprises one main stem 21 and three branches 22, the electric connection mode of the connection part 211 and the lamp holder is the same as the above description, here no need to describe in detail.

Only a buckle structure 3 may not ensure the stability of the assembly of the subunits, when the lamp holder is sleeved on the outer side wall of the installation part 212, the assembled subunits are much more stable.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A lamp unit, comprising:

a main stem comprising a first end and a second end; and at least two branches;

wherein:

the at least two branches extend outwards from the first end of the main stem;

the second end of the main stem comprises a connection part that is adapted for connecting to a power supply;

one end of each branch comprises a mounting part which is adapted to accommodate a light source or corresponds to a connection part of another lamp unit;

one end of each branch comprises a fixing part, and the mounting part is a lamp base fixedly disposed on the fixing part; and the lamp unit is a hollow structure and comprises two subunits, each subunit comprising one fixing part for fixing the lamp base.

2. The lamp unit of claim 1, wherein the two subunits are assembled through a buckle structure, and contact surfaces of the two subunits comprise flanges and grooves which are corresponding to one another; when the two subunits are assembled, the flanges are clamped in the grooves.

3. The lamp unit of claim 1, wherein the second end of the main stem protrudes outwards to form an installation part, the installation part is sleeved with a lamp holder which corresponds to and is electrically connected to the lamp base, to form the connection part electrically connected to the power supply.

4. The lamp unit of claim 3, wherein the connection part is electrically connected to lamp bases in parallel, a side wall of each installation part for fixing the lamp base comprises an opening allowing power lines to pass through, one of the power lines extends out of a chamber of the lamp unit via the opening, winds on an outer side wall of the installation part, and is electrically connected to the lamp holder fixed on the installation part.

5. A lamp body, comprising a plurality of lamp units of claim 1, wherein, when in use, the connection part of one of the plurality of lamp units is electrically connected to a power supply, and each mounting part receives a light source or is electrically connected to a connection part of another lamp unit.

6. A lamp, comprising a base and a lamp body of claim 5 disposed on the base, the base comprising a power socket, and the connection part of one lamp unit is electrically connected to the power socket.

7. A lamp unit, comprising:

a main stem comprising a first end and a second end; and at least two branches;

wherein the at least two branches extend outwards from the first end of the main stem;

the second end of the main stem comprises a connection part that is adapted for connecting to a power supply;

one end of each branch comprises a mounting part which is adapted to accommodate a light source or corresponds to a connection part of another lamp unit;

one end of each branch comprises a fixing part, and the mounting part is a lamp base fixedly disposed on the fixing part; and the lamp unit is a hollow structure and comprises three subunits, each subunit comprising one fixing part for fixing the lamp base.

8. The lamp unit of claim 7, wherein the three subunits are assembled through a buckle structure, and contact surfaces of the three subunits comprise flanges and grooves which are corresponding to one another; when the three subunits are assembled, the flanges are clamped in the grooves.

9. The lamp unit of claim 7, wherein the second end of the main stem protrudes outwards to form an installation part, the installation part is sleeved with a lamp holder which corresponds to and is electrically connected to the lamp base, to form the connection part electrically connected to the power supply.

10. The lamp unit of claim 9, wherein the connection part is electrically connected to lamp bases in parallel, a side wall of each installation part for fixing the lamp base comprises an opening allowing power lines to pass through, one of the power lines extends out of a chamber of the lamp unit via the opening, winds on an outer side wall of the installation part, and is electrically connected to the lamp holder fixed on the installation part.

11. A lamp unit, comprising:

a main stem comprising a first end and a second end; and at least two branches;

wherein the at least two branches extend outwards from the first end of the main stem;

the second end of the main stem comprises a connection part that is adapted for connecting to a power supply;

one end of each branch comprises a mounting part which is adapted to accommodate a light source or corresponds to a connection part of another lamp unit;

one end of each branch comprises a fixing part, and the mounting part is a lamp base fixedly disposed on the fixing part; and the main stem and the branches are formed by injection molding, the lamp base is fixedly clamped on the fixing part; one end of the lamp base for receiving a light source or a connection part of another lamp unit is provided with a convex tooth extending outwards to prevent the lamp base from detaching from the fixing part.

12. The lamp unit of claim 11, wherein the lamp unit is a hollow structure and comprises two subunits, each subunit comprising one fixing part for fixing the lamp base.

13. The lamp unit of claim 12, wherein the two subunits are assembled through a buckle structure, and contact surfaces of the two subunits comprise flanges and grooves which are corresponding to one another; when the two subunits are assembled, the flanges are clamped in the grooves.

14. The lamp unit of claim 12, wherein the second end of the main stem protrudes outwards to form an installation part, the installation part is sleeved with a lamp holder which corresponds to and is electrically connected to the lamp base, to form the connection part electrically connected to the power supply.

15. The lamp unit of claim 14, wherein the connection part is electrically connected to lamp bases in parallel, a side wall of each installation part for fixing the lamp base comprises an opening allowing power lines to pass through, one of the power lines extends out of a chamber of the lamp unit via the opening, winds on an outer side wall of the installation part, and is electrically connected to the lamp holder fixed on the installation part.

16. The lamp unit of claim 11, wherein the lamp unit is a hollow structure and comprises three subunits, each subunit comprising one fixing part for fixing the lamp base.

17. The lamp unit of claim 16, wherein the three subunits are assembled through a buckle structure, and contact surfaces of the three subunits comprise flanges and grooves which are corresponding to one another; when the three subunits are assembled, the flanges are clamped in the grooves.

18. The lamp unit of claim 16, wherein the second end of the main stem protrudes outwards to form an installation part, the installation part is sleeved with a lamp holder which corresponds to and is electrically connected to the lamp base, to form the connection part electrically connected to the power supply.

19. The lamp unit of claim 18, wherein the connection part is electrically connected to lamp bases in parallel, a side wall of each installation part for fixing the lamp base comprises an opening allowing power lines to pass through, one of the power lines extends out of a chamber of the lamp unit via the opening, winds on an outer side wall of the installation part, and is electrically connected to the lamp holder fixed on the installation part.

* * * * *